US010964523B1

(12) United States Patent
Gayasov et al.

(10) Patent No.: US 10,964,523 B1
(45) Date of Patent: Mar. 30, 2021

(54) LASER-PUMPED PLASMA LIGHT SOURCE AND METHOD FOR LIGHT GENERATION

(71) Applicants: RnD-ISAN, Ltd, Moscow (RU); ISTEQ B.V., Eindhoven (NL)

(72) Inventors: Robert Rafilevich Gayasov, Moscow (RU); Denis Alexandrovich Glushkov, Nieuwegein (NL); Yurii Borisovich Kiryukhin, Moscow (RU); Vladimir Mikhailovich Krivtsun, Moscow (RU); Aleksandr Andreevich Lash, Moscow (RU)

(73) Assignees: RnD-ISAN, Ltd, Moscow (RU); ISTEQ B.V., Eindhoven (NL)

( * ) Notice: Subject to any disclaimer, the term of this patent is extended or adjusted under 35 U.S.C. 154(b) by 0 days.

(21) Appl. No.: 16/986,424

(22) Filed: Aug. 6, 2020

Related U.S. Application Data

(63) Continuation-in-part of application No. 16/814,317, filed on Mar. 10, 2020, now Pat. No. 10,770,282.

(30) Foreign Application Priority Data

Mar. 5, 2020 (RU) ..... RU2020109782

(51) Int. Cl.

| | |
|---|---|
| ***H01J 61/62*** | (2006.01) |
| ***H01J 61/16*** | (2006.01) |
| *H01J 61/30* | (2006.01) |
| *H01J 61/52* | (2006.01) |

(52) U.S. Cl.
CPC ..... *H01J 61/62* (2013.01); *H01J 61/16* (2013.01); *H01J 61/302* (2013.01); *H01J 61/52* (2013.01); *H01J 2893/0063* (2013.01)

(58) Field of Classification Search
CPC ..... H01J 61/62; H01J 61/16; H01J 61/302; H01J 61/52
See application file for complete search history.

(56) References Cited

U.S. PATENT DOCUMENTS 5,379,315 A * 1/1995 Meinzer ..... H01S 3/0941 372/101
6,331,993 B1 * 12/2001 Brown ..... H01S 3/09415 372/55

(Continued)

*Primary Examiner* — Anne M Hines
(74) *Attorney, Agent, or Firm* — Nadya Reingand; Yan Hankin

(57) ABSTRACT

The invention relates to plasma light sources with a continuous optical discharge (COD). The light source contains a gas filled chamber with a region of radiating plasma sustained by a focused beam of a CW laser. A density of gas particles in the chamber is less than $90 \cdot 10^{19}$ $cm^{-3}$ and a temperature of the chamber is in a range from 600 to 900 K or optionally higher. Preferably the density of gas particles is as low as possible and the temperature of the inner surface of the chamber at operation is as high as possible under providing a gas pressure in the chamber of about 50 bar or more. The technical result of the invention consists in providing COD sustaining conditions, which are optimal for achieving high stability and high brightness of the radiating plasma, in the creation on this basis of broadband light sources with ultra-high brightness and stability.

22 Claims, 6 Drawing Sheets

(56) References Cited

U.S. PATENT DOCUMENTS

| | | | | |
|---|---|---|---|---|
| 2016/0381776 | A1‡ | 12/2016 | Derstine | H05H 1/24<br>250/503.1 |
| 2017/0278694 | A1‡ | 9/2017 | Chuang | H01J 61/54 |
| 2018/0233878 | A1‡ | 8/2018 | Leonardo | H01S 3/302 |

* cited by examiner
‡ imported from a related application

LASER-PUMPED PLASMA LIGHT SOURCE AND METHOD FOR LIGHT GENERATION

CROSS-REFERENCE TO RELATED APPLICATIONS

This patent application is a Continuation of U.S. patent application Ser. No. 16/814,317, filed on 10 Mar. 2020, which claims priority to Russian patent application RU2020109782 filed Mar. 5, 2020, all of which are incorporated herein by reference in their entireties.

FIELD OF INVENTION

The present invention relates to laser-pumped plasma light sources producing high-brightness light in the ultraviolet (UV), visible and near infrared (NIR) spectral bands and to methods of generating broadband radiation from the plasma of continuous optical discharge (COD).

BACKGROUND OF INVENTION

Continuous optical discharge is a stationary gas discharge sustained by laser radiation in pre-created relatively dense plasma. COD-based light sources with a plasma temperature of about 15,000 K are among the highest brightness continuous light sources in a wide spectral range between about 0.1 μm and 1 μm (Raizer, "Optical Discharges," Sov. Phys. Usp. 23(11), November 1980, pp. 789-806). Compared to arc lamps, such laser-pumped plasma light sources not only have a higher brightness, but also a longer lifetime, making them preferable for numerous applications.

The indicated temperature of the radiating plasma, about 15,000 K, is practically fixed, since when an attempt is made to increase it by increasing the power of a continuous wave (CW) laser (within 2-10 times, but not by many orders of magnitude), the plasma volume will increase, and the additional power will be released by radiation and thermal conductivity from the increased volume and surface of the plasma-gas interface. In other words, the plasma temperature is largely stabilized by the COD itself, by the conditions of its existence. In this regard, in order to increase the brightness to sustain the COD, pulsed lasers with a high repetition rate are used, including in conjunction with the use of a CW laser, the power of which is not lower than the threshold power required to sustain the COD, as is known, for example, from patent RU 2571433, issued on Dec. 20, 2015.

However, with this approach, there is a problem of instability of a high-brightness laser-pumped plasma light source.

This drawback is largely overcome in the broadband light source known from U.S. Pat. No. 9,368,337, issued on Jun. 14, 2016, in which the optically transparent COD plasma has a shape elongated along the axis of the CW laser beam. Plasma radiation is collected in the longitudinal direction, which results in a high brightness of the light source.

However, with longitudinal collection of plasma radiation, the problem of blocking laser radiation in an output beam of plasma radiation arises. Solving the problems of increasing the brightness, increasing the absorption coefficient of laser radiation by the plasma, and significantly reducing the numerical aperture of the blocked diverging laser beam that has passed through the plasma, this device does not completely solve the problem of light source brightness stability.

In the broadband light source known from U.S. Pat. No. 9,357,627, issued on May 31, 2016, plasma radiation is collected in directions other than the directions of propagation of the laser beam. Along with this, due to the optimization of light source configuration in which the laser beam is directed vertically upward along the camera axis and the region of radiating plasma is in the immediate vicinity of the upper part of the chamber, the energy and spatial stability of the broadband plasma light source is increased by suppressing the turbulence of convective flows in the gas-filled chamber.

The problem of increasing the stability and control of convective gas flows, the turbulent flow of which leads to instability of the brightness of the light source was also solved by optimizing the geometry of the camera and the light source as a whole in a number of U.S. patent Ser. No. 10/008,378, issued on Jun. 26, 2018; Ser. No. 10/109,473, issued on Oct. 23, 2018; U.S. Pat. No. 9,887,076, issued on Feb. 6, 2018, Ser. No. 10/244,613, issued on Mar. 26, 2019. However, the optimal conditions for obtaining continuous generation of plasma radiation with high spectral brightness, close to the maximum achievable for light sources of this type, more than 50 mW/(mm$^2$·sr·nm), and low relative brightness instability a, less than 0.1% were not determined.

SUMMARY

The technical problem to be solved by the invention relates to the creation of devices and methods for the optimal generation of broadband radiation from the COD plasma and the development on their basis of highly stable high-brightness plasma light sources with laser pumping.

The essence of the invention is to provide the highest possible brightness of the light source due to the high density of high-temperature (~15000 K) COD plasma, said plasma density provided by the high pressure of the surrounding gas, equal to 50-100 bar or higher. A distinctive feature is that such high pressures p are provided (according to the ratio $p \propto nT$) at a minified density n of gas atoms but using as high as possible gas temperature T (in the range from 600 to 900 K or higher). Minimizing the gas density and the refraction, associated with this density, in turn, provides highly efficient suppression of the light source brightness instability, associated with the turbulence of convective gas flows in gas-filled chamber. Thus, the invention provides the achievement of ultra-high brightness of the plasma light source with ultra-low instability of its brightness.

The technical result of the invention consists in providing COD sustaining conditions, which are optimal for achieving high stability and high brightness of the radiating plasma, in the creation on this basis of broadband light sources with ultra-high brightness and stability.

Achievement of the purpose is possible by means of the proposed laser-pumped plasma light source, comprising: a gas filled chamber, at least a part of which is optically transparent, a means for plasma ignition, a region of radiating plasma sustained in the chamber by a focused beam of a continuous wave (CW) laser, and at least one output beam of plasma radiation exiting the chamber.

The light source is characterized in that an optimal continuous generation of the output beam of plasma radiation is achieved by a fact that a density of gas particles in the chamber is less than $90 \cdot 10^{19}$ cm$^{-3}$ and a temperature of an inner surface of the chamber is in a range from 600 to 900 K or optionally higher.

In a preferred embodiment of the invention, the optimal continuous generation is characterized by a high spectral brightness of the light source, more than 50 mW/($mm^2$·nm·sr), and by a low relative instability of the brightness σ less than 0.1%.

In a preferred embodiment of the invention, the density of gas particles is as low as possible and the temperature of the inner surface of the chamber at operation is as high as possible under providing a gas pressure in the chamber of about 50 bar or more.

In a preferred embodiment of the invention, the density of gas particles is not less than $46 \cdot 10^{19}$ $cm^{-3}$, which corresponds to a gas pressure at room temperature of not less than 17 bar.

In an embodiment of the invention, the gas is xenon and the wavelength of the CW laser is 808 nm.

In an embodiment of the invention, at least a part of the chamber arranged for exit of the output beam of plasma is spherical, and the region of radiating plasma is located in a center of the spherical part of the chamber.

In the embodiment of the invention, a radius of an internal surface of the spherical part of the chamber is less than 5 mm, preferably not more than 3 mm.

In an embodiment of the invention, the focused beam of the CW laser is directed into the chamber from bottom to top and an axis of the focused beam is directed vertically or close to vertical.

In an embodiment of the invention, a part or a detail of the chamber is located above the region of radiating plasma at a minimal possible distance from it, not more than 3 mm, which does not have any negative impact on a lifetime of the chamber and its transparency.

In a preferred embodiment of the invention, the chamber is provided with a heater.

In a preferred embodiment of the invention, a transparent part of the chamber is made from a material belonging to a group of sapphire, leucosapphire ($Al_2O_3$), fused quartz, crystalline quartz ($SiO_2$), crystalline magnesium fluoride ($MgF_2$).

In a preferred embodiment of the invention, a means for plasma ignition comprises a solid-state laser system generating two pulsed laser beams in a Q-switching mode and in a free-running mode.

In an embodiment of the invention, the beam of the CW laser and each output beam of plasma radiation exiting the chamber do not cross each other outside the region of radiating plasma.

In an embodiment of the invention, the laser-pumped plasma light source has three or more output beams of plasma radiation.

In another aspect, the invention relates to a method for light generation comprising: plasma igniting within gas filled chamber and an radiating plasma sustaining by a focused beam of a CW laser to produce at least one output beam of plasma radiation exiting from a region of radiating plasma through an optically transparent part of the chamber.

The method is characterized in that the chamber is filled with a gas with a particles density of less than $90 \cdot 10^{19}$ $cm^{-3}$ and the plasma is sustained by the focused beam of CW laser at a temperature of an inner surface of the chamber in a range from 600 to 900 K or optionally higher.

In a preferred embodiment of the invention, a gas pressure in the chamber at operation is close to 50 bar or more to provide a high spectral brightness of a light source, more than 50 mW/($mm^2$·nm·sr).

In the preferred embodiment of the invention, the temperature of the inner surface of the chamber is as high as possible at the lowest possible density of gas particles to provide a low relative instability of a brightness σ less than 0.1%.

In a preferred embodiment of the invention, using a heater located outside the chamber, the chamber is rapidly heated to a temperature of its inner surface in the range from 600 to 900 K before a plasma igniting.

In a preferred embodiment of the invention, the focused beam of the CW laser is directed into the chamber from bottom to top along a vertical.

In a preferred embodiment, a turbulence of convective flows in the chamber is suppressed by placing an upper wall or part of the chamber above the region of radiating plasma at a minimum possible distance from it, not more than 3 mm, while said distance avoids causing any negative impact on the lifetime of the chamber and its transparency.

In a preferred embodiment, the chamber is filled with xenon and radiating plasma is sustained by the focused beam of the CW laser with a wavelength of 808 nm.

In a preferred embodiment, the plasma igniting is produced by focused into the chamber two pulsed laser beams generated by a solid-state laser system in a free-running mode and in a Q-switched mode.

The advantages and features of the present invention will become more apparent from the following non-limiting description of exemplary embodiments thereof, given by way of example with reference to the accompanying drawings.

BRIEF DESCRIPTION OF DRAWINGS

The essence of the invention is explained by the drawings, in which.

In the drawings, the matching elements of the device have the same reference numbers.

These drawings do not cover and, moreover, do not limit the entire scope of options for implementing this technical solution, but are only illustrative examples of particular cases of its implementation

DETAILED DESCRIPTION OF THE PREFERRED EMBODIMENTS

This description is provided to illustrate how the invention can be implemented and in no way to demonstrate the scope of this invention.

Figure 1:
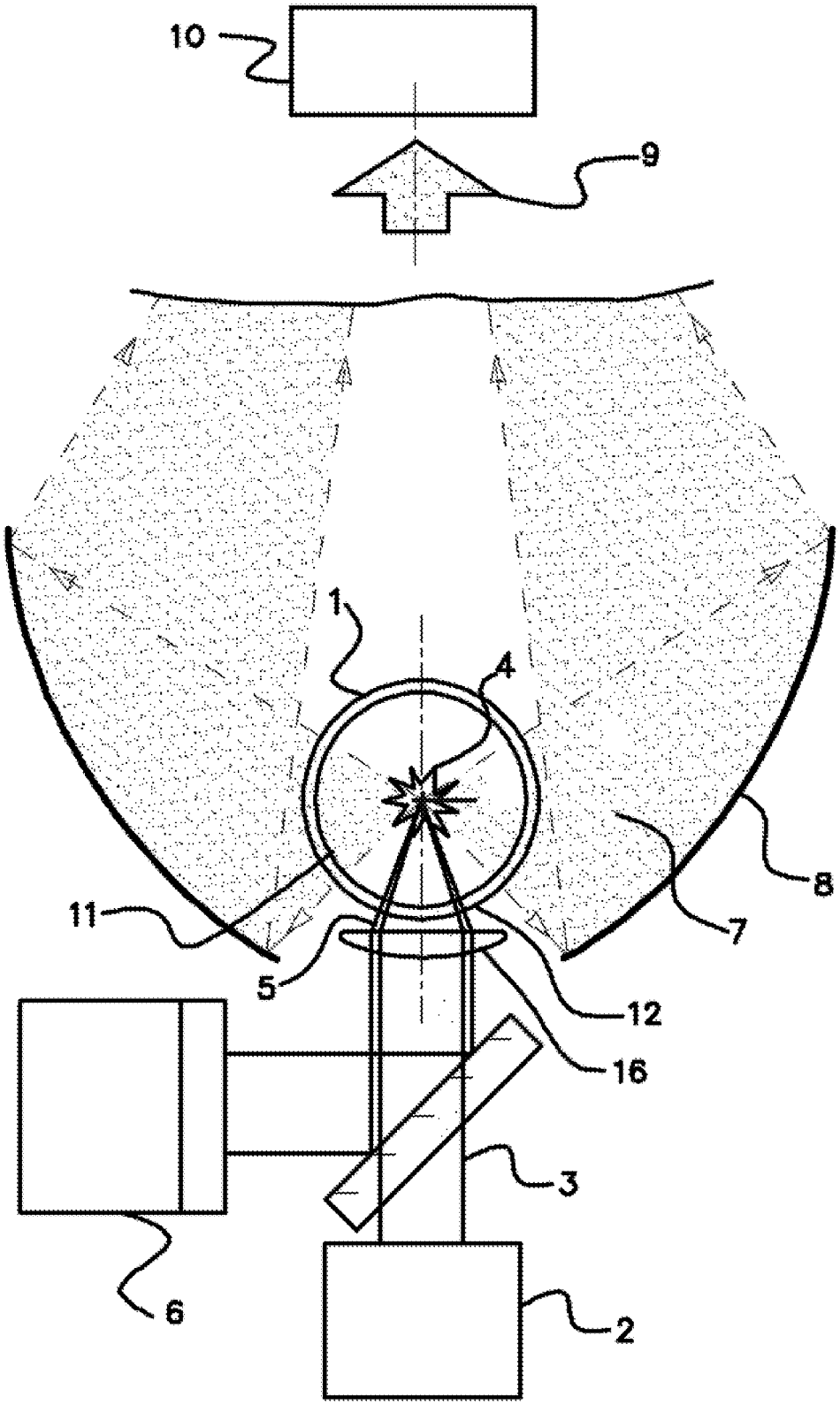
FIG. 1—a schematic representation of a light source in accordance with an embodiment of the present invention, FIG. 2—spectral brightness of the light source as a function of the xenon gas pressure for CW laser wavelengths $\lambda_{CW}$=976 nm and $\lambda_{CW}$=808 nm.

According to the example of invention embodiment shown in FIG. 1, the laser-pumped plasma light source comprises the high-pressure gas filled chamber 1, at least part of which is optically transparent. FIG. 1 shows an embodiment with a completely transparent chamber manufactured from an optically transparent material, e.g. fused quartz. The light source also contains a means for igniting the plasma, which can be a pulsed laser system 2, generating at least one pulsed laser beam 3, which is focused into the chamber 1, namely into the region intended for sustaining the radiating plasma 4.

In other embodiments of the invention, ignition electrodes may be used as the means for igniting the plasma.

After plasma ignition, the region of radiating plasma 4 is sustained in the chamber in a continuous mode by a focused beam 5 of a CW laser 6. At least one output beam (or useful beam) of plasma radiation 7 directed to the optical collector 8 and intended for subsequent use, exits the chamber 1. The optical collector 8 forms the radiation beam 9 transmitted, for example, via an optical fiber and/or a system of mirrors to one or more optical consumer systems 10, which uses broadband plasma radiation.

In accordance with the present invention, the optimal continuous generation of the output beam of plasma radiation 7 is achieved by a fact that a density of gas particles in the chamber 1 is less than $90 \cdot 10^{19}$ $cm^{-3}$ and a temperature of an inner surface of the chamber is in a range from 600 to 900 K or optionally higher, if higher temperature does not have any negative impact on the lifetime of the chamber and its transparency.

The effect achieved by the invention is due to the factor that for a given amount of gas in a given volume of the chamber, the gas pressure increases with the temperature of inner surface of the chamber. Since the temperature of the radiating plasma is practically fixed (about 15000 K, and attempts to raise this temperature are difficult, since they are accompanied only by an increase in the plasma volume) and the pressure in the plasma is equal to the pressure in the chamber, the density of the radiating plasma increases with increasing pressure in the chamber, and hence with increasing temperature of the chamber wall. An increase in the density of the radiating plasma leads to an increase in the volumetric luminosity of the radiating plasma and, as a consequence, to an increase in the brightness of the light source in a wide optical range, where the radiating plasma is practically transparent.

The same increase in brightness can be obtained by increasing the gas pressure at a given temperature of the chamber. However, in this case, the gas-particles density and the refraction associated with this density will increase, which, in a turbulent flow, both in the radiating plasma region and at the periphery, will lead to significant instability (fluctuations) of the brightness of the light source.

It should be noted that with an increase in the temperature of the chamber and gas, the turbulence of convective flows in the chamber also decreases for the following reasons. First, heating the chamber leads to a decrease in temperature gradients and gas density gradients in the chamber, which leads to suppression of convective flows between the hotter region of the plasma and the surrounding colder gas. Second, the nature of the gas flow is determined by the Reynolds number Re, and turbulence is suppressed when the Reynolds number becomes less than the critical one. The Reynolds number depends on the gas density ρ, gas flow rate ν, and dynamic viscosity η:

$$Re \approx \rho \cdot \nu / \eta \quad (1).$$

The dynamic viscosity increases with increase of temperature:

$$\eta \cdot \eta_0 \sqrt{T/T_0} \quad (2),$$

where $\eta_0$ is the dynamic viscosity of the gas at room temperature $T_0 \approx 300$ K . In accordance with this, the Reynolds number depends on the density of the gas, its velocity and temperature as follows:

$$Re \approx \sqrt{T_0/T} \cdot \rho \cdot \nu / \eta_0 \quad (3).$$

In accordance with formula (3), suppression of gas flow turbulence is possible by increasing the absolute temperature T of the chamber and gas. Other possibilities for suppressing of turbulence and increasing the stability of the light source involve limiting the density of the gas ρ and its velocity ν. The latter is realized, in particular, due to a decrease in the dimensions of the chamber, since the acceleration of the gas heated in the region of radiating plasma and floating up under the action of the Archimedean force is limited by the dimensions of the chamber.

In general, the higher the gas pressure and thus the pressure in the radiating plasma, the higher the brightness of the light source is. In accordance with (3), the lower the gas density, the lower the turbulence of the covective gas flow. In addition, the lower the gas density ρ, the lower its refractive index and the lower the aberrations associated with the refraction of light in the convective gas flow. Accordingly, the lower the density of the gas, the less is the instability of brightness and other output parameters of the light source.

In order to provide the relative instability of brightness to be sufficiently small, $\sigma \leq 0.1\%$, the density of gas particles in the chamber is chosen below the experimentally determined upper limit of $90 \cdot 10^{19}$ $cm^{-3}$, which corresponds to a gas pressure of about 33.5 bar at room temperature. At the same time, to obtain the spectral brightness of the light source close to the maximum achievable, more than 50 mW/($mm^2 \cdot sr \cdot nm$ at the temperatures in the range from 600 to 900 K or higher, the gas pressure and, accordingly, the density of the radiating plasma should be high enough to provide optimal gas pressure of about 50 bar or more at operation. For this purpose, the density of gas particles in the chamber is selected above the experimentally determined lower limit of $46 \cdot 10^{19}$ $cm^{-3}$, which corresponds to a gas pressure at room temperature of not less than 17 bar.

Thus, to provide a high spectral brightness and low relative instability of the brightness, the density of gas particles should be as low as possible while the temperature of the inner surface of the chamber at operation should be as high as possible under providing a gas pressure in the chamber of about 50 bar or more.

In an embodiment of the invention, the temperature of the inner surface of the chamber at operation is 600 K and the density of gas particles is $65 \cdot 10^{19}$ $cm^{-3}$, which corresponds to a gas pressure of 24.5 bar at room temperature and 50 bar at operation.

In preferable embodiment of invention, the chamber can operate at its inner surface temperature as high as 860 K and the density of gas particles may be chosen as low as $46 \cdot 10^{19}$ $cm^{-3}$, which corresponds to a gas pressure of 17 bar at room temperature and 50 bar at operation.

Figure 2:
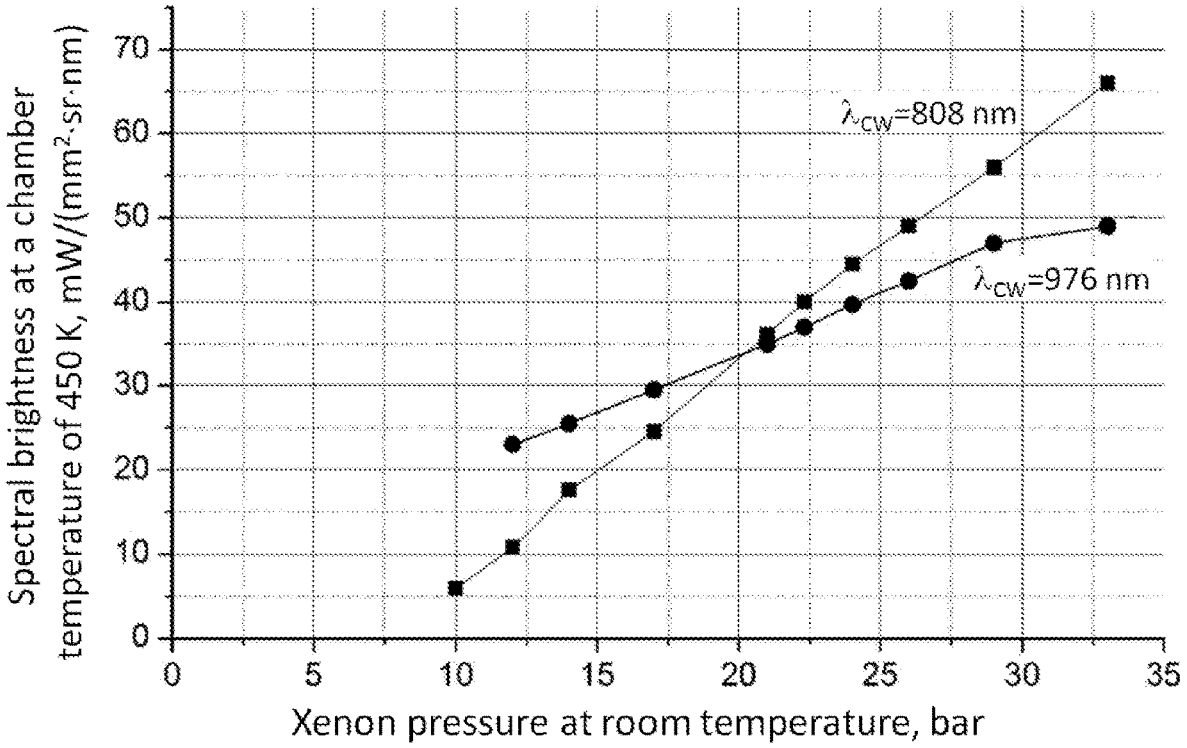

For illustration, FIG. 2 shows the dependence of the spectral brightness of the light source on the pressure of xenon gas in the chamber at room temperature. The measurements were carried out in the spectral range of 600-500 nm at the stationary mode of operation with chamber temperature of 450 K. In the indicated spectral range, the spectral brightness is about 25% lower than in the maximum observed near wavelengths of about 400 nm. The measurements were made for two CW diode lasers with a radiation power of 65 W at wavelengths $\lambda_{CW}$=976 nm and $\lambda_{CW}$=808 nm.

The research results show that for both wavelengths of laser radiation, high spectral brightness is achieved at a gas pressure in the chamber of at least 25 bar at room temperature. High stability of the radiation intensity, $\sigma \leq 0.1\%$, is sustained at a gas pressure in the chamber up to 36 bar at room temperature.

The measurements showed a confident tendency to increase the brightness while sustaining high stability of the output parameters of the light source with an increase in the chamber temperature to 600 K and higher.

In accordance with the invention, the use of inert xenon is preferred as the gas, which ensures safe operation and a long lifetime of the light source. In addition, compared to the radiating plasma of other inert gases, Xe plasma is characterized by the highest optical o in a wide spectral range, including UV, visible and IR regions.

The choice of the preferred wavelength of high-efficient CW diode laser is due to the following factors. Near the laser wavelength 976 nm, there are strong absorption lines of Xe, in which the lower state is populated as the temperature rises. Near 808 nm, such lines are spaced farther from the absorption lines and, therefore, at a given laser power, sufficient absorption to sustain a continuous optical discharge is achieved at a higher plasma density and temperature than in the case of 976 nm.

Accordingly, in a preferred embodiment of the invention, the gas, filling the chamber, is xenon and a wavelength of the CW laser is 808 nm.

Other embodiments of the invention are aimed at further increasing the stability of the output parameters of the light source, which include intensity, brightness, spectrum, and spatial position of the radiating plasma while ensuring the highest possible brightness of the source.

Figure 3:
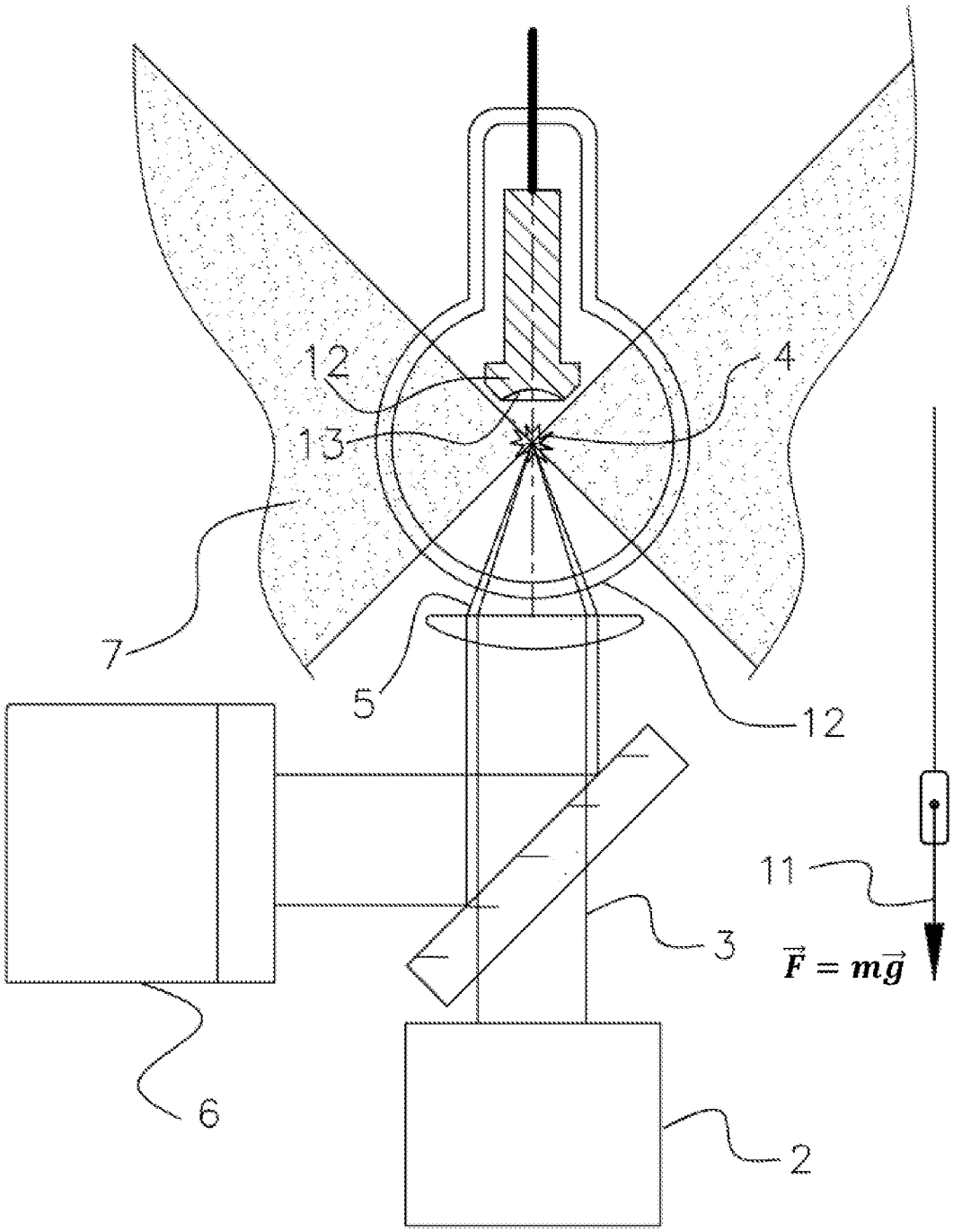
FIG. 3, FIG. 4 show schematic representations of a light source in accordance with embodiments of the invention.

In a preferred embodiment, a focused beam of CW laser is directed into the chamber from bottom to top, and the axis of said beam is directed vertically parallel to the force of gravity 11, FIG. 3, or close to vertical. The further improvement the light source stability is due to the fact that usually the region of radiating plasma 4 is slightly shifted from the focus towards focused beam 5 of the CW laser to that cross section of the focused laser beam where the intensity of focused beam 5 of the CW laser is still sufficient to sustain the region of radiating plasma 4. When focused beam 5 of a CW laser is directed from bottom to top, the region of radiating plasma 4, which contains the hottest and lowest mass density plasma, tends to float under the action of the Archimedean force. Ascending, the region of radiating plasma 4 reaches a place closer to the focus, where the cross section of focused beam 5 of the CW laser is smaller and the intensity of laser radiation is higher. On the one hand, this increases the brightness of the plasma radiation, and on the other hand, it balances the forces acting on the region of radiating plasma, which ensures high stability of the light source.

To realize these positive effects, it is preferable that chamber 1 is axisymmetric and the axis of focused beam 5 of the CW laser be aligned with the axis of symmetry of the chamber.

The stability of the output characteristics of the light source is also influenced by the magnitude of the pulse acquired under the action of the Archimedean force by a gas heated in the region of radiating plasma 4. The momentum acquired by the gas and the turbulence of convective flows are the less, the closer the region of radiating plasma 4 is to the upper wall of the chamber or to the part of the chamber located above the region of radiating plasma 4. Therefore, in order to increase the stability of the output characteristics of the light source in the embodiment shown in FIG. 3, part or detail 12 of the chamber is located on top of the region of radiating plasma 4 at the minimum possible distance from it, less than 3 mm, which does not have any negative impact on a lifetime of the chamber and its transparency.

Also, part 12 of the chamber can be arranged for reflection and focusing into the plasma 4 both the CW laser beam, which has passed through the region of radiating plasma, and the part of the plasma radiation. This reduces the radiative losses and increases the efficiency of the light source. In accordance with this embodiment of the invention shown in FIG. 3, part 12 of the chamber close to the plasma contains a surface that is a concave spherical mirror 13 with center in the region of radiating plasma 4.

In a preferred embodiment, at least the part of the chamber 1 intended for the exit of output beam of plasma radiation 7 is spherical or nearly spherical, and the region of radiating plasma 4 is located in the center of symmetry of the spherical part of chamber 1, as shown in FIG. 1 and FIG. 3. This minimizes chromatic and spherical aberrations, caused by the transparent walls of the chamber into the paths of rays of plasma radiation.

The suppression of aberrations associated with the turbulence of convective flows is achieved, in particular, by reducing the chamber size. Therefore, in an embodiment of the invention, the radius of the inner surface of the spherical part of the chamber is less than 5 mm, preferably not more than 3 mm.

Figure 4:
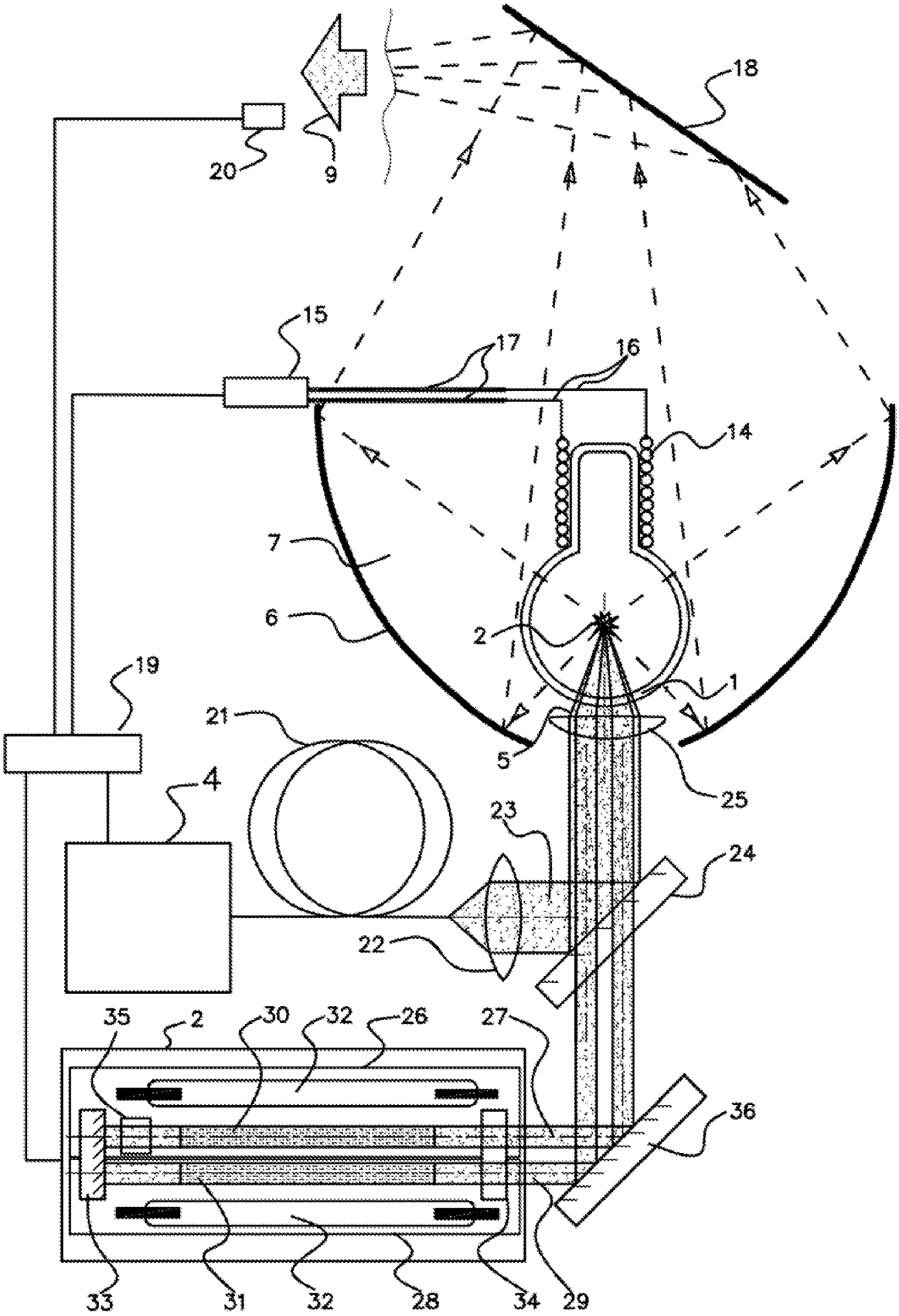

FIG. 4 shows an embodiment of the invention in which the chamber is equipped with a heater. The heater can consist of a heating coil 14 and a current source 15 connected to the heating coil through a temperature bridge 16 intended to provide a temperature difference between heating coil 36 and current-carrying busbars 17. Additionally, current-carrying busbars 17 can be provided with a heat exchanger (not shown), for example in the form of air-cooled radiators. The chamber can consist of a spherical part and a cylindrical part, on which a heating coil 14 is located. The chamber can also be equipped with a thermocouple to measure the temperature of the chamber. In addition, heating coil 14 may be housed in a heat insulating jacket (not shown).

The heater is designed for pre-starting heating of the chamber to the operating temperature, which facilitates the ignition of the plasma and provides a quick transition of the light source to the steady-state operating mode with a preset optimum high temperature of the chamber, which is in the range from 600 to 900 K.

In an embodiment of the invention, the optical collector includes a parabolic mirror 8 and a deflecting mirror 18 intended to form a beam of plasma radiation 9, preferably transported by optical fiber to an optical system that uses broadband plasma radiation.

In a preferred embodiment of the invention, the high-brightness plasma light source comprises a control unit 19 with the function of automatically sustaining a given power in the output beam of plasma radiation 7, FIG. 4. For this, the light source is equipped with a power meter 20, to which a small part of the light flux from beam of plasma radiation 9 is supplied with a coupler (not shown). Preferably, the control unit is connected to a heater 15, a power meter 20, and a power supply unit of CW laser 6. Maintaining the specified power in the beam of plasma radiation 9 is carried out by control unit 19 according to the feedback circuit between power meter 20 and the power supply unit of CW laser 6. In addition, control unit 19 can be made with the function of thermal stabilization of the chamber at its optimum high temperature. This embodiment of the invention improves the stability of power and brightness of the laser-pumped plasma light source in a long-term continuous mode of operation.

As shown in FIG. 4, in a preferable embodiment of the invention, the CW laser 6 with fiber-optic output is used. At output of optical fiber 21, the expanding laser beam is directed to collimator 22, for example, in the form of a condenser lens. After collimator 22, expanded parallel beam 23 of the CW laser is directed by means of a deflecting mirror 24 to a focusing optical element 25, for example, in the form of an aspherical lens, providing sharp focusing of the CW laser beam 5, which is necessary to ensure high brightness of the light source.

In preferable embodiment of the invention, a solid-state laser system 2, which contains a first laser 26 for generating a first laser beam 27 in the Q-switched mode and contains a second laser 28 for generating a second laser beam 29 in a free-running mode, is used for reliable plasma ignition. Pulsed lasers with active elements 30, 31 are equipped with sources of optical pumping, for example, in the form of flash lamps 32 and preferably have common cavity mirrors 33, 34. First laser 26 is equipped with a Q-switch 35. Two pulsed laser beams 27, 29 are focused into the chamber, in the region intended to sustain radiating plasma 2, FIG. 4. First laser beam 27 is intended for optical breakdown. Second laser beam 29 is intended to create a plasma, the volume and density of which are sufficient for stationary maintenance of the region of radiating plasma 4 by a focused beam 5 of a CW laser.

Preferably, the wavelength of the CW laser $\lambda_{CW}$ is different from the wavelengths $\lambda_1$, $\lambda_2$ of first and second pulsed laser beams 27, 29. As an example, the wavelength of the CW laser may be $\lambda_{CW}$=808 nm or 976 nm, and the pulsed lasers may have an emission wavelength of $\lambda_1=\lambda_2$=1064 nm. This allows dichroic mirror 24 to be used to input CW laser beam 23 and pulsed laser beams 27, 29 into the chamber. To transport pulsed laser beams 27, 29, a rotary mirror 36 can be additionally used, FIG. 4.

FIG. 1, FIG. 3, FIG. 4 show that when using a pulsed laser system 2 for plasma ignition, chamber 1 allows the output of plasma radiation in all azimuths. In an embodiment, the exit of the output beam of plasma radiation from the chamber is carried out into a spatial angle of at least 9 sr or more than 70% of the total solid angle. In this case the opening angle of the output beam 7 of plasma radiation (flat angle with respect to the plane of the drawing) is not less than 90°.

Figure 5:
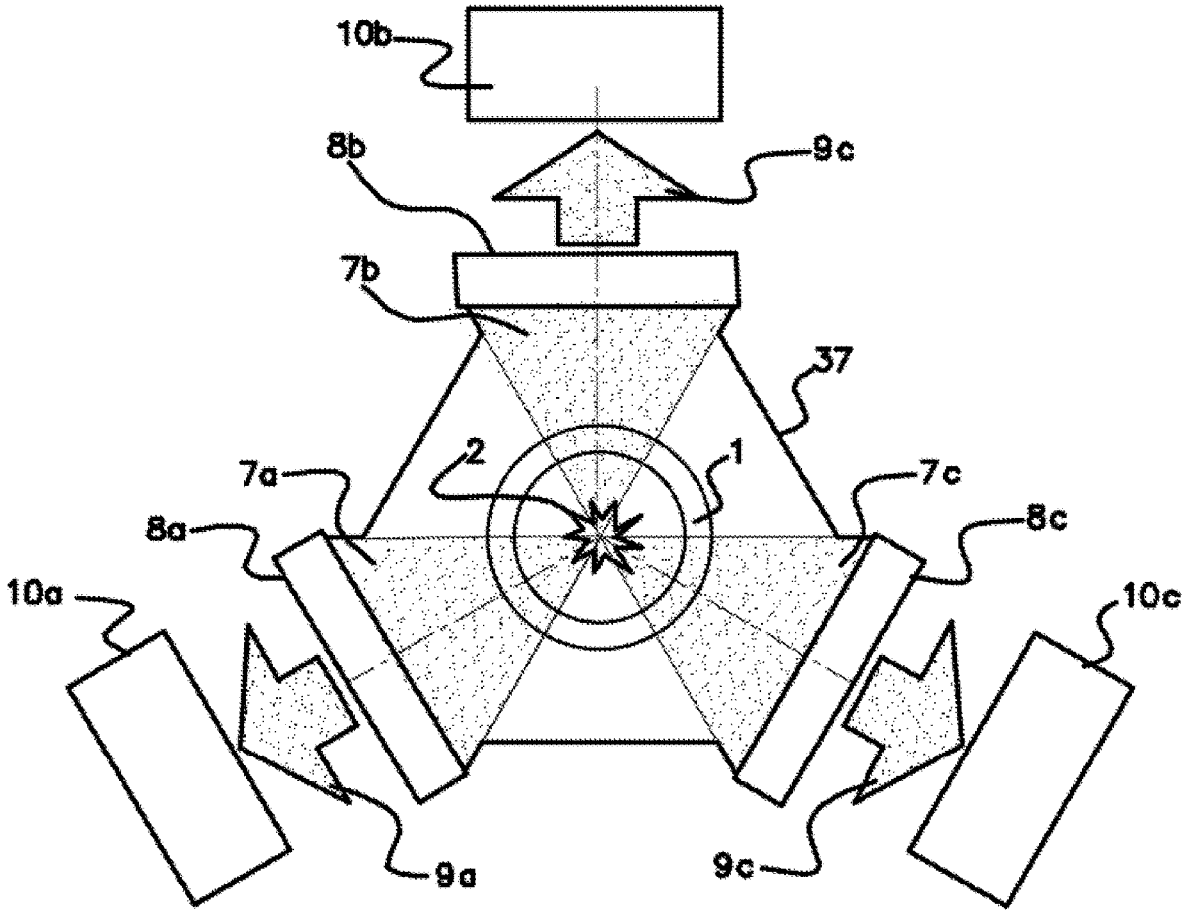
FIG. 5, FIG. 6 show schematic representations of a light source with several beams of plasma radiation with laser and electric discharge plasma ignition.

Along with the output of the output beam of plasma radiation 7 to the optical collector 8 in all azimuths, the light source according to the present invention is not limited to this embodiment only. In other embodiments of the invention, the light source may have at least three homocentric output beam of plasma radiation s 7*a*, 7*b*, 7*c*, as illustrated in FIG. 5, which shows a cross-section of a light source in a horizontal plane passing through the region of radiating plasma 4. The laser beams in FIG. 5, which ignite and sustain a continuous optical discharge, are located below the plane of the drawing. The use of several, in particular three beams of plasma radiation from a single light source is required for a number of industrial applications. In this embodiment, the laser pumped light source chamber 1 can be housed in a housing 37, which is equipped with three optical collectors 8*a*, 8*b*, 8*c*. Three optical collectors 8*a*, 8*b*, 8*c* form beams of plasma radiation 9*a*, 9*b*, 9*c*, transported, for example, by optical fiber to optical consumer systems 10*a*, 10*b*, 10*c*, using broadband plasma radiation. This allows the use of one light source for three or more optical consumer systems, ensuring the compactness of the system and the identity of the parameters of broadband radiation in all optical channels.

Figure 6:
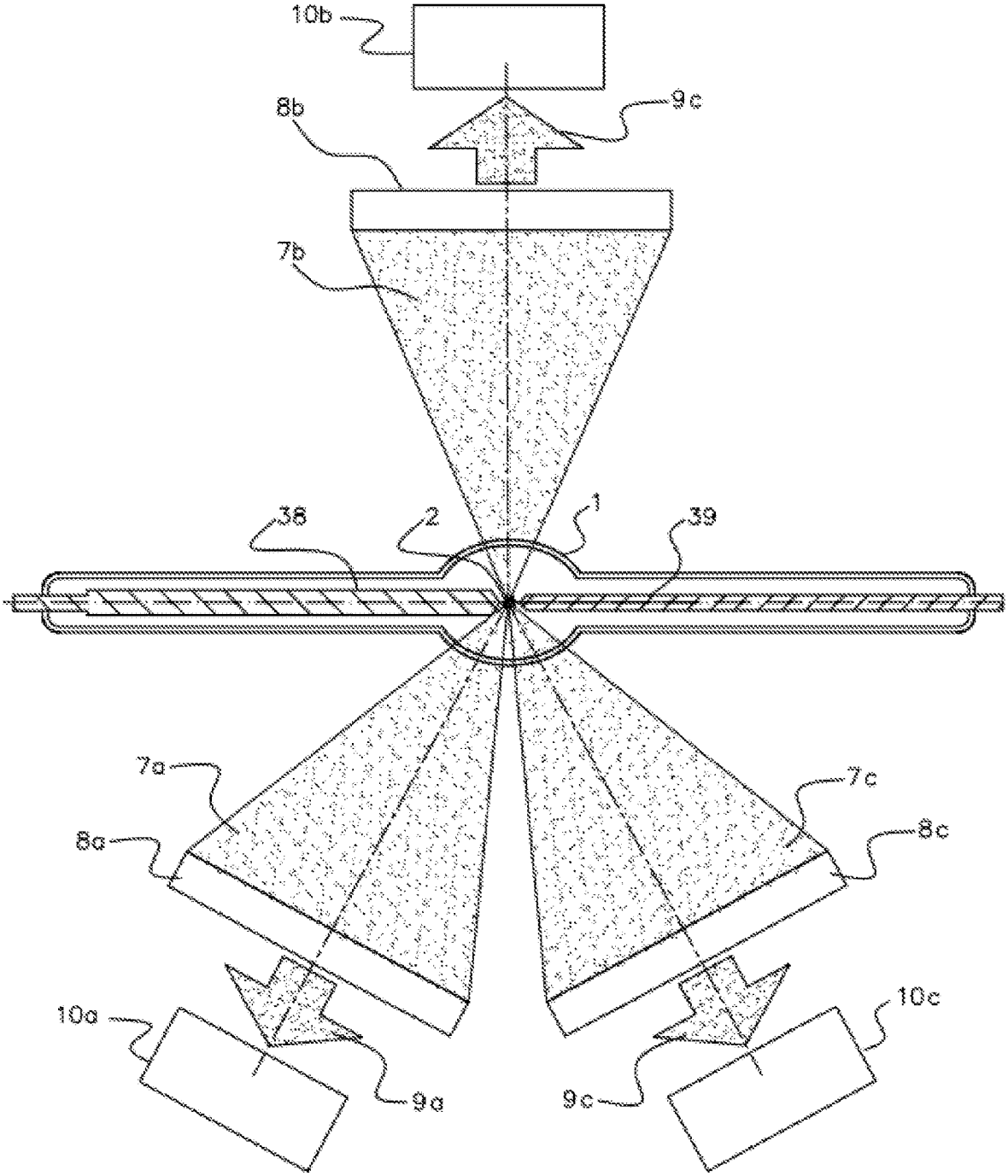

FIG. 6 shows another version of a light source with three radiation output channels, in which two ignition electrodes 38, 39 are used as a means for plasma ignition, connected to a high-voltage pulsed power supply (not shown). The parts of device which in this embodiment are the same as those in the above-described embodiment (FIG. 5), have in FIG. 6 the same reference numbers and their detailed description is omitted.

In a preferred embodiment of the invention, the transparent part of the chamber is made of quartz. In other embodiments, the transparent part of the chamber can be made of an optically transparent material belonging to the group of sapphire, leucosapphire, fused silica, crystalline silica, crystalline magnesium fluoride.

A method for light generation from a COD plasma using the proposed laser-pumped plasma light source shown in FIG. 1, FIG. 3, FIG. 4, FIG. 5, FIG. 6 is as follows. A chamber 1 is filled with a gas with a particles density of less than $90\cdot10^{19}$ $cm^{-3}$, which corresponds to a pressure 35.5 bar at room temperature. The focused beam 5 of the CW laser 6 is directed into the chamber 1. With the help of means for plasma ignition, which can be either ignition electrodes or a pulsed laser system 2, plasma is ignited. The concentration and volume of initial plasma are sufficient to reliably sustain a continuous optical discharge by a focused beam 5 of a CW laser 6. In a steady-state stationary mode of operation, the region of radiating plasma is sustained by a focused beam of a CW laser at a temperature of the inner surface of the chamber in the range from 600 to 900 K or optionally higher. At least one output beam of plasma radiation is directed from a region of radiating plasma 4 through an optically transparent part of the chamber 1.

By heating the walls of the chamber to the specified temperature, a multiple, two to three or more times increase in the pressure of the gas surrounding the region of radiating plasma is provided. Since the pressure in the plasma is equal to the pressure in the chamber, the density of the radiating plasma is increased due to the heating of the chamber walls, which leads to an increase in the volumetric luminosity of the radiating plasma and, as a consequence, to an increase in the brightness of the light source in a wide optical range. In this case, an increase in the gas pressure and the brightness of the light source is achieved without increasing the gas density and the proportional to it refraction, which at a turbulent flow lead to significant instability of the light source brightness. As shown above when considering formula (3), the suppression of convective flow turbulence is possible by increasing the gas temperature T, decreasing or limiting its density p and decreasing the gas flow velocity ν, which is implemented in the proposed method for generating light.

To achieve a high spectral brightness of a light source, more than 50 $mW/(mm^2\cdot nm\cdot sr)$ a gas pressure in the chamber at operation is provided close to 50 bar or more.

To achieve a low relative instability of a brightness σ less than 0.1% the temperature of the inner surface of the chamber is provided as high as possible at the lowest possible density of gas particles The velocity of the gas flow ν ascending from the region of radiating plasma is minimized by positioning the upper wall or part of the chamber at the minimum possible, not exceeding 3 mm, distance from the region of radiating plasma. In an embodiment, the size of the chamber is chosen so that the walls of the chamber are located at a distance from the region of radiating plasma not exceeding 3 mm, which helps to suppress the turbulence of convective flows in the chamber.

Thus, the invention allows, at high brightness, close to the maximum achievable for sources of this type, to provide high stability of the laser pumped plasma light source.

In an embodiment of the method, the chamber is heated after ignition of the plasma in the process of bringing the light source to a stationary mode of operation due to the radiation power of a CW laser entering the chamber.

In another embodiment, prior to the ignition of the plasma by an external heater, including elements 14, 15, 16, 17, FIG. 4, the chamber 1 is rapidly heated to a temperature ranging from 600 to 900 K. This facilitates the ignition of the plasma and reduces the time the light source reaches a stationary mode of operation, simplifying its design and increasing ease of use. The specified temperature of the inner surface of the chamber is maintained by the radiation power of the CW laser and the heater.

In order to further increase the stability of the light source, a focused beam of CW laser is directed into the chamber from bottom to top along the vertical, which increases the brightness and spatial stability of the region of radiating plasma. In this case, the CW laser beam is preferably focused in the center of symmetry of that part of the chamber through which the output beam of plasma radiation passes out. This reduces optical aberrations, which can distort the path of the beams when broadband plasma radiation passes through the transparent walls of the chamber and reduce the brightness of the light source when transporting its radiation.

To achieve the maximum possible brightness of the light source, xenon gas is preferably used, and the laser is a continuous diode laser with a wavelength of 808 nm, FIG. 2.

In an embodiment of the invention, the plasma is ignited by two pulsed laser beams 27, 29 of a solid-state pulsed laser system 2, focused in the region of radiating plasma, FIG. 4. Two pulsed laser beams 27, 29 provide optical-induced breakdown and the creation of an initial plasma, the density of which is higher than the threshold density of a continuous optical discharge plasma, which has a value of about $10^{18}$ electrons/$cm^3$. In this embodiment, the reliability of laser ignition and ease of use of the light source are achieved. In contrast to sources using electrodes for starting plasma ignition, it is possible to optimize the geometry of the chamber, reduce the turbulence of convective gas flows in it and minimize optical aberrations, as well as increase the spatial angle of the plasma radiation collection.

In general, the claimed invention makes it possible to: increase the brightness and ensure high stability of the laser pumped plasma radiation source.

INDUSTRIAL APPLICABILITY

High-brightness, highly stable laser pumped light sources made in accordance with the present invention can be used in various projection systems, for spectrochemical analysis, spectral microanalysis of biological objects in biology and medicine, in microcapillary liquid chromatography, for inspection of the optical lithography process, for spectrophotometry and other purposes.

What is claimed is:

1. A laser-pumped plasma light source, comprising: a gas filled chamber, at least a part of which is optically transparent, a means for plasma ignition, a region of radiating plasma sustained in the chamber by a focused beam of a continuous wave (CW) laser, and at least one output beam of plasma radiation exiting the chamber, wherein an optimal continuous generation of the output beam of plasma radiation is achieved by a fact that a density of gas particles in the chamber is less than $90 \cdot 10^{19}$ $cm^{-3}$ and a temperature of an inner surface of the chamber is in a range from 600 to 900 K or optionally higher.

2. The light source according to claim 1, wherein the optimal continuous generation is characterized by a high spectral brightness of the light source, more than 50 mW/($mm^2 \cdot nm \cdot sr$), and by a low relative instability of the brightness $\sigma$ less than 0.1%.

3. The light source according to claim 1, wherein the density of gas particles is not less than $46 \cdot 10^{19}$ $cm^{-3}$, which corresponds to a gas pressure at room temperature of not less than 17 bars.

4. The light source according to claim 1, wherein the density of gas particles is as low as possible and the temperature of the inner surface of the chamber at operation is as high as possible under providing a gas pressure in the chamber of about 50 bars or more.

5. The light source according to claim 1, wherein the gas is xenon and a wavelength of the CW laser is 808 nm.

6. The light source according to claim 1, wherein at least a part of the chamber designed for outputting of the plasma radiation beam is spherical, and the radiating plasma region is located in a center of the spherical part of the chamber.

7. The light source according to claim 6, wherein a radius of an internal surface of the spherical part of the chamber is less than 5 mm, preferably not more than 3 mm.

8. The light source according to claim 1, wherein the focused beam of the CW laser is directed into the chamber from bottom to top, and an axis of the focused beam is directed vertically or close to vertical.

9. The light source according to claim 1, wherein a part or a detail of the chamber is located above the region of radiating plasma at a minimal possible distance from it, not more than 3 mm, which does not have any negative impact on a lifetime of the chamber and its transparency.

10. The light source according to claim 1, wherein the chamber is provided with a heater.

11. The light source according to claim 1, wherein a transparent part of the chamber is made from a material belonging to a group of sapphire, leucosapphire ($Al_2O_3$), fused quartz, crystalline quartz ($SiO_2$), crystalline magnesium fluoride ($MgF_2$).

12. The light source according to claim 1, wherein a means for plasma ignition comprises a solid-state laser system generating two pulsed laser beams in a Q-switching mode and in a free-running mode.

13. The light source according to claim 1, in which the beam of the CW laser and each output beam of plasma radiation exiting the chamber, do not cross each other outside the region of radiating plasma.

14. The light source according to claim 1 with three or more output beams of plasma radiation.

15. A method for light generation, comprising: plasma igniting within a gas filled chamber and plasma sustaining by a focused beam of a CW laser to produce at least one output beam of plasma radiation exiting from a region of radiating plasma through a transparent part of the chamber, wherein the chamber is filled with a gas with a particles density of less than $90 \cdot 10^{19}$ $cm^{-3}$ and the plasma is sustained by the focused CW laser beam at a temperature of an inner surface of the chamber, in a range from 600 to 900 K or optionally higher.

16. The method according to claim 15, wherein a gas pressure in the chamber at operation is close to 50 bars or more to provide a high spectral brightness of a light source, more than 50 mW/($mm^2 \cdot nm \cdot sr$).

17. The method according to claim 16, wherein the temperature of the inner surface of the chamber is as high as possible at the lowest possible density of gas particles to provide a low relative instability of a brightness σ less than 0.1%.

18. The method according to claim 15, wherein using a heater located outside the chamber, the chamber is rapidly heated to a temperature of its inner surface in the range from 600 to 900 K before a plasma igniting.

19. The method according to claim 15, wherein the focused beam of the CW laser is directed into the chamber from bottom to top along a vertical.

20. The method according to claim 15, wherein a turbulence of convective flows in the chamber is suppressed by placing an upper wall or a part of the chamber above the region of radiating plasma at a minimum possible distance from it, not more than 3 mm, while said distance avoids causing any negative impact on the lifetime of the chamber and its transparency.

21. The method according to claim 15, wherein the chamber is filled with xenon and radiating plasma is sustained by the focused beam of the CW laser with a wavelength of 808 nm.

22. The method according to claim 15, wherein a plasma igniting is produced by focused into the chamber two pulsed laser beams generated by a solid-state laser system in a free-running mode and in a Q-switched mode.

* * * * *